US008622101B2

(12) United States Patent
Smith et al.

(10) Patent No.: US 8,622,101 B2
(45) **Date of Patent: *Jan. 7, 2014**

(54) FILLER TUBE ASSEMBLY

(75) Inventors: Gregory F. Smith, Grosse Pointe, MI (US); David G. Smith, Grosse Pointe, MI (US)

(73) Assignee: David G. Smith, Grosse Pointe, MI (US)

( * ) Notice: Subject to any disclaimer, the term of this patent is extended or adjusted under 35 U.S.C. 154(b) by 480 days.

This patent is subject to a terminal disclaimer.

(21) Appl. No.: 12/840,023

(22) Filed: Jul. 20, 2010

(65) Prior Publication Data

US 2011/0011860 A1 Jan. 20, 2011

Related U.S. Application Data

(63) Continuation-in-part of application No. 11/616,521, filed on Dec. 27, 2006, now Pat. No. 7,757,729.

(60) Provisional application No. 60/754,873, filed on Dec. 29, 2005.

(51) Int. Cl.
*B65B 1/30* (2006.01)

(52) U.S. Cl.
USPC ..... 141/206; 141/198; 141/302; 141/389; 220/86.2

(58) Field of Classification Search
USPC ..... 141/4, 46, 59, 95, 198, 206, 286, 302, 141/389; 220/86.1, 86.2, 746
See application file for complete search history.

(56) References Cited

U.S. PATENT DOCUMENTS

| | | | | |
|---|---|---|---|---|
| 3,967,660 | A | 7/1976 | Russell | |
| 4,157,104 | A | 6/1979 | Lofquist, Jr. | |
| 4,441,533 | A * | 4/1984 | Snyder et al. | 141/59 |
| 4,700,864 | A | 10/1987 | Galles et al. | |
| 4,861,478 | A | 8/1989 | Hall | |
| 5,056,570 | A * | 10/1991 | Harris et al. | 141/59 |
| 5,183,087 | A | 2/1993 | Aubel et al. | |
| 5,297,595 | A * | 3/1994 | Haile et al. | 141/59 |

(Continued)

FOREIGN PATENT DOCUMENTS

CA 2348809 C 1/2006

OTHER PUBLICATIONS

PCT Search Report for Application No. PCT/US2006/049538, dated Sep. 13, 2007, 3 pages.

*Primary Examiner* — Gregory Huson
*Assistant Examiner* — Jason K Niesz
(74) *Attorney, Agent, or Firm* — Howard & Howard Attorneys PLLC

(57) ABSTRACT

A filler tube assembly is used with a fuel pump nozzle having a pressure sensing port. The filler tube assembly includes a receiver having an inner wall defining an aperture, which receives the pump nozzle. The inner wall defines an orifice and a seal is coupled to the inner wall about the orifice for defining a chamber between the inner wall, the seal, and the fuel pump nozzle when the fuel pump nozzle is disposed in the aperture. A vacuum tube has a coupled end in fluid communication with the orifice and an open end in fluid communication with the fuel tank. The receiver defines a rim for seating the fuel pump nozzle in the aperture to align the pressure sensing port with the orifice. When fuel covers the open end of the vacuum tube, a pressure change is transmitted through the filler tube assembly to the pressure sensing port.

24 Claims, 7 Drawing Sheets

(56) References Cited

U.S. PATENT DOCUMENTS

| | | | | |
|---|---|---|---|---|
| 5,327,943 | A | 7/1994 | Strock et al. | |
| 5,562,133 | A | 10/1996 | Mitchell | |
| 5,571,249 | A | 11/1996 | Boylen | |
| 5,878,795 | A | 3/1999 | Armellino | |
| 5,894,809 | A | 4/1999 | Grigaitis et al. | |
| 5,944,069 | A | 8/1999 | Nusbaumer et al. | |
| 5,950,688 | A | 9/1999 | Langlois | |
| 5,975,154 | A | 11/1999 | Bennett | |
| 5,988,458 | A | 11/1999 | Messner | |
| 6,026,853 | A | 2/2000 | Osterbrink | |
| 6,237,645 | B1 | 5/2001 | Pountney | |
| 6,289,945 | B1 | 9/2001 | Haboush, II | |
| 6,712,102 | B2 | 3/2004 | Zerangue, Sr. | |
| 6,729,367 | B2 | 5/2004 | Peterson | |
| 6,935,264 | B2 | 8/2005 | Harris | |
| 7,360,565 | B2 * | 4/2008 | Peterson et al. | 141/326 |
| 2003/0056837 | A1 | 3/2003 | Benjey | |
| 2005/0126657 | A1 | 6/2005 | Allman et al. | |
| 2005/0205156 | A1 | 9/2005 | Ganachaud et al. | |
| 2006/0254654 | A1 | 11/2006 | Cotton | |
| 2007/0144612 | A1 | 6/2007 | Burkholder | |
| 2009/0014091 | A1 * | 1/2009 | Kobayashi et al. | 141/286 |

* cited by examiner

FILLER TUBE ASSEMBLY

CROSS-REFERENCE TO RELATED APPLICATIONS

This application is a continuation-in-part application of and claims the benefit of U.S. patent application Ser. No. 11/616,521, now U.S. Pat. No. 7,757,729, filed Dec. 27, 2006, which claims the benefit of Provisional Application No. 60/754,873 filed Dec. 29, 2005, both of which are incorporated herein by reference

BACKGROUND OF THE INVENTION

1. Field of the Invention

The present invention is a filler tube assembly for communicating fuel from a fuel pump nozzle to a fuel tank with the fuel pump nozzle having a pressure sensing port.

2. Description of the Related Art

Fuel overflow during the fueling of boats is common and results in fuel contamination of lakes, rivers, and other waterways. Federal law prohibits spilling fuel into a lake, river, or waterway, and penalties for violating such laws may be severe. Such fuel overflow has been reduced by advancements in fuel pump nozzles, but such advancements have not eliminated overflow and the resulting pollution of waterways.

Boats generally include a fuel tank and a filler tube assembly extending from a surface of the boat to the fuel tank. The filler tube assembly includes a receiver that receives a fuel pump nozzle. Standard fuel pump nozzles generally have an automatic shut-off system. When activated, the automatic shut-off system discontinues the flow of fuel through the fuel pump nozzle. Specifically, the automatic shut-off system responds to a pressure change at the pressure sensing port. The fuel pump nozzle draws a vacuum through the pressure sensing port and when the pressure sensing port is covered, e.g., with fuel, the automatic shut-off system senses the change in pressure and discontinues the flow of fuel through the fuel pump nozzle.

Generally, as the fuel tank is filled with fuel, the fuel level rises to the top of the tank, into the filler tube assembly, and into the receiver. When the fuel level covers the pressure sensing port on the fuel pump nozzle, the pressure sensing port senses a pressure change which activates the automatic shut-off system on the fuel pump nozzle. Fuel flow is thereby terminated, thus preventing fuel overspill from the fuel fill neck.

Fuel tanks on boats typically include a vent tube to dissipate pressure increases in the fuel tank and to prevent vacuum when an engine is drawing fuel from the fuel tank. The vent tube is generally in the form of a tube connecting from the fuel tank to a side of the boat, thereby allowing the fuel tank to remain at atmospheric pressure. In today's boats, the height of the vent tube may be below the height of the receiver fitting. Therefore, as the fuel tank is filled, and as the fuel level rises to the top of the fuel tank into the filler tube assembly, fuel also rises at a corresponding level in the vent tube. If the height of the vent tube on the side of the boat is lower than the receiver, and hence lower than the pressure sensing port, fuel evacuates through the vent tube and onto the waterway surface before the fuel flow is terminated by the automatic shut-off system on the fuel pump nozzle.

Fuel overflow also occurs when, upon filling the tank, the tank belches, thereby expelling some fuel back through the receiver fitting. Belching is generally caused by turbulent flow in the fuel fill neck. Belching may also be caused by air that is trapped with the fuel as the fuel enters the fuel fill neck.

As a result the backpressure created by the air restricts or eliminates fuel flow, generally at which point the fill neck belches, or releases, the air through the receiver fitting, which may result in fuel splashing out of the receiver fitting.

In addition, underground fuel reservoirs are generally at a temperature substantially cooler than the temperature of the boat's fuel tank and the fuel undergoes thermal expansion after it is pumped from the cool reservoir to the warm fuel tank. Generally expansion continues after the fuel tank is filled and the fuel fill receiver is capped, resulting in excess fuel being expelled through the vent tube and onto the waterway surface.

Accordingly, it would be desirable to manufacture a filler tube assembly that activates the automatic shut-off system on the fuel pump nozzle when the fuel reaches a predetermined level to prevent leakage of fuel through the vent tube and to leave excess volume to accommodate for thermal expansion of fuel.

SUMMARY OF THE INVENTION AND ADVANTAGES

The present invention is a filler tube assembly for communicating fuel from a fuel pump nozzle to a fuel tank with the fuel pump nozzle having a pressure sensing port. The filler tube assembly includes a receiver having an inner wall defining an aperture for receiving the fuel pump nozzle. The inner wall defines an orifice extending through the inner wall transverse to the aperture. A seal is coupled to the inner wall about the orifice for defining a chamber between the inner wall, the seal, and the fuel pump nozzle. A vacuum tube has a coupled end coupled to the receiver and in fluid communication with the orifice and an open end for disposition in fluid communication with the fuel tank. The receiver defines a rim rigidly extending from the inner wall into the aperture for seating the fuel pump nozzle in the aperture to dispose the pressure sensing port in the chamber and to align the pressure sensing port with the orifice.

Accordingly, the operator of the fuel pump nozzle may seat the fuel pump nozzle against the rim to assure that the pressure sensing port is aligned with the orifice. Because the vacuum tube provides fluid communication between the fuel tank and the orifice, a pressure change at the open end of the vacuum tube is transmitted to the orifice. Further, the pressure difference at the orifice is sensed by the fuel pump nozzle through the pressure sensing port. As such, when the open end of the vacuum tube is covered, e.g., with fuel, a pressure change at the open end is transmitted through the vacuum tube to the orifice and to the pressure sensing port of the fuel pump nozzle. The open end of the vacuum tube may be located at a predetermined level to prevent leakage of fuel through the vent tube and/or to leave excess volume to accommodate for thermal expansion of fuel.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE INVENTION

Figure 1:
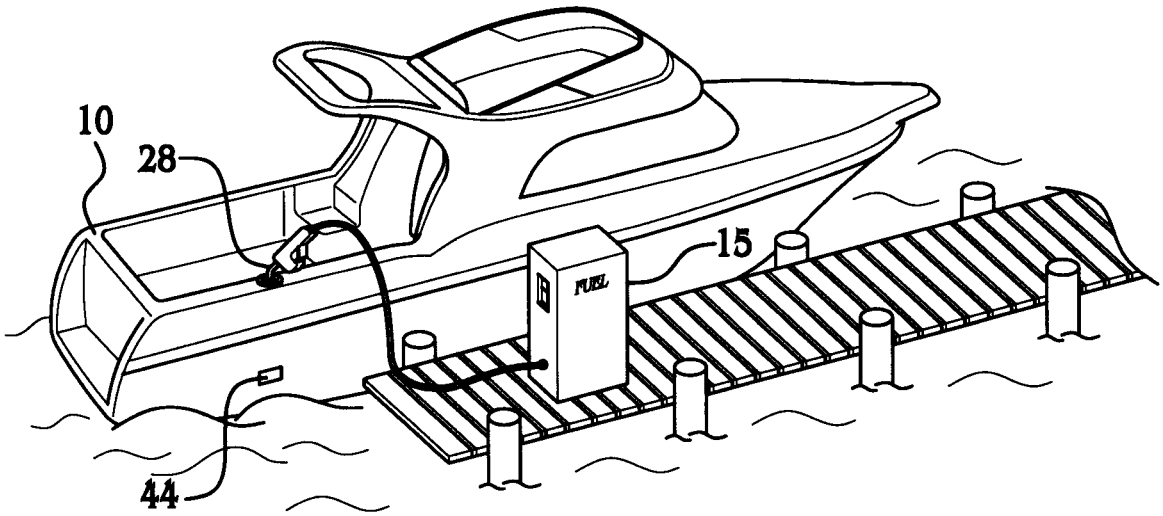
FIG. 1 is a perspective view of a boat.

Referring to the Figures, wherein like numerals indicate like or corresponding parts throughout the several views, a fuel storage system 11 is generally shown. The fuel storage system 11 receives fuel from a fuel pump nozzle 28 having a pressure sensing port 42. For example, the fuel pump nozzle 28 may be found in a standard fuel filling station and may be coupled to a fuel pump 15. As is known in the art, the fuel pump nozzle 28 includes an automatic shut-off system. When activated, the automatic shut-off system discontinues the flow of fuel through the fuel pump nozzle 28. Specifically, the automatic shut-off system responds to a pressure change at the pressure sensing port 42. The fuel pump nozzle 28 draws a vacuum through the pressure sensing port 42 and when the pressure sensing port 42 is covered, e.g., with fuel, the automatic shut-off system senses the change in pressure and discontinues the flow of fuel through the fuel pump nozzle 28.

The fuel storage system 11 is shown throughout the Figures in use with a boat 10; however it should be appreciated that the fuel storage system 11 is not limited to use in boats. For example, the fuel storage system 11 may be used in vehicles such as marine craft, automobiles, construction equipment, tractors, and spacecraft. The fuel storage system 11 may also be used with any type of machinery such as an electric generator. Alternatively, the fuel storage system 11 may be used with portable or stationary liquid storage devices, e.g., portable gasoline tanks. It should also be appreciated that the fuel storage system 11 may be used in a power boat as well as a sail boat.

Figure 3:
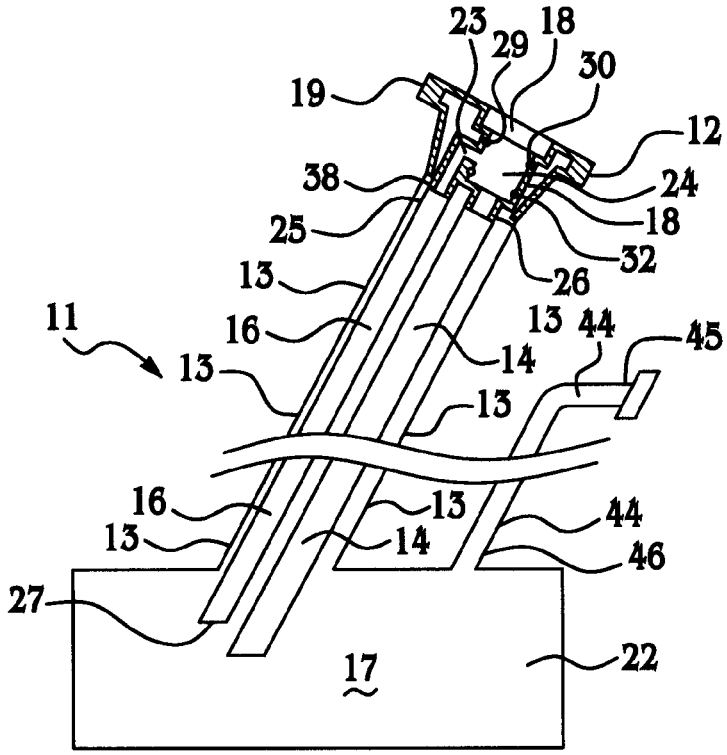
FIG. 3 is a cross-sectional view of the filler tube assembly in use with a fuel storage system.

As shown in FIG. 3, the fuel storage system 11 includes a fuel tank 22 and a filler tube assembly 12 coupled to the fuel tank 22. The filler tube assembly 12 communicates fuel from a fuel pump nozzle 28 to the fuel tank 22. In other words, fuel is pumped from the fuel pump nozzle 28 through the filler tube assembly 12 and into the fuel tank 22. Specifically, the fuel tank 22 defines an interior 17 for storing fuel and fuel is pumped through the filler tube assembly 12 and into the interior 17 of the fuel tank 22.

Figure 2:
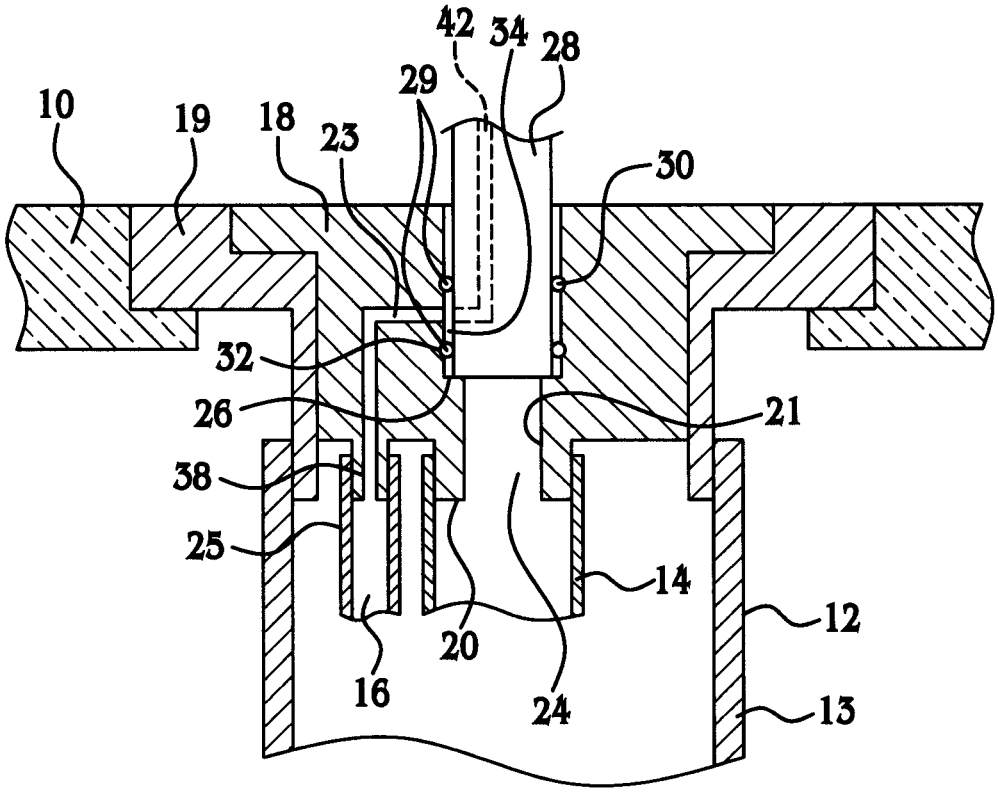
FIG. 2 is a cross-sectional view of a portion of a filler tube assembly.

As shown in FIG. 2, the boat 10 may include a deck fitting 19 that is rigidly attached to a surface of the boat 10. In such an embodiment, a fuel hose 13 extends between the deck fitting 19 and the fuel tank 22. The receiver 18 is disposed within the deck fitting 19. The receiver 18 is integral with or an insert to the deck fitting 19. The receiver 18 may be pivotable within the deck fitting to aid in the ease of insertion of the fuel pump nozzle into the receiver 18. The receiver may be manufactured from a flexible material to aid in the ease of insertion of the fuel pump nozzle 28 into the receiver 18. It should be appreciated that the receiver 18 and the deck fitting 19 may be sealed to one another and the receiver 18 may be sealed to the fuel pump nozzle 28 when disposed in the receiver 18 such that air may not exhaust through the filler tube assembly 12 during fueling. Alternatively, the receiver 18 and the deck fitting 19 may be configured to allow for exhaust of air through the filler tube assembly 12 during fueling.

As shown in FIGS. 3-6, the fuel tank 22 may include a vent tube 44 including a first end 45 for communication with ambient atmosphere and a second end 46 coupled to the fuel tank 22. Specifically, the first end 45 is in fluid communication with the interior 17 of the fuel tank 22.

As shown in FIG. 2, the filler tube assembly 12 includes a receiver 18 having an inner wall 21 defining an aperture 24 for receiving the fuel pump nozzle 28. The inner wall 21 defines an orifice 23 extending through the inner wall 21 transverse to the aperture 24. The fuel hose 13 is coupled to the receiver 18 in alignment with the aperture 24 for coupling with the fuel tank 22 to communicate fuel from the receiver 18 to the fuel tank 22. The aperture 24 of the receiver 18 may be sized, for example, such that the receiver 18 may receive a fuel pump nozzle 28 that pumps gasoline or is sized, for example, such that the receiver 18 receives a fuel pump nozzle 28 that pumps diesel fuel.

The filler tube assembly 12 includes a seal 29 coupled to the inner wall 21 about the orifice 23 for defining a chamber 34 between the inner wall 21, the seal 29, and the fuel pump nozzle 28. In other words, the chamber 34 is aligned with the orifice 23 when the fuel pump nozzle 28 is disposed in the aperture 24. Specifically, upon fueling, the receiver 18 receives the fuel pump nozzle 28. More specifically, the aperture 24 receives the fuel pump nozzle 28 and the fuel pump nozzle 28 abuts the rim 26. When the fuel pump nozzle 28 is inserted in the receiver 18, the seal 29 sealingly engages the fuel pump nozzle 28. The seal 29 creates an air-tight seal with the fuel pump nozzle 28 thus creating the chamber 34. Because the chamber 34 is aligned with the orifice and the seal 29 sealingly engages the fuel pump nozzle 28, fluid communication with the chamber 34 is limited to fluid communication through the orifice 23. The seal 29 is preferably made from conductive material such that static electricity is discharged through the seal 29 to an electrical ground and is preferably resistant to fuels and/or the seal is preferably self lubricating. It should be appreciated that without departing from the nature of the present invention, the seal 29 may have any configuration such that the seal 29 is coupled to the inner wall 21 about the orifice 23.

The receiver 18 defines a rim 26 rigidly extending from the inner wall 21 into the aperture 24 for seating the fuel pump nozzle 28 in the aperture 24. Specifically, the rim 26 seats the fuel pump nozzle 28 in the aperture 24 to dispose the pressure sensing port 42 in the chamber 34 and to align the pressure sensing port 42 with the orifice 23. In other words, when the fuel pump nozzle 28 is seated on the rim 26, the pressure sensing port 42 is aligned with the chamber 34 and is therefore aligned with the orifice 23. The aperture 24 extends along an axis A and the rim 26 may extend annularly about the axis A and may project perpendicularly from the inner wall 21.

The rim 26 and the inner wall 21 may be integrally formed from a common material. Alternatively, the rim 26 may be formed separately from the inner wall 21 and subsequently coupled to the inner wall 21. It should be appreciated that the rim 26 may have any configuration that acts to seat the fuel pump nozzle 28 in the aperture 24. For example, the rim 26 may be a bar extending across the aperture 24.

As shown in FIG. 3, the filler tube assembly 12 includes a vacuum tube 16 having a coupled end 25 coupled to the receiver 18 and in fluid communication with the orifice 23 and an open end 27 disposed in fluid communication with the fuel tank 22. In other words, the coupled end 25 of the vacuum tube 16 is coupled to the orifice 23 and the open end 27 of the vacuum tube 16 is disposed at a predetermined vertical position. An air path through the vacuum tube 16, orifice 23, and the chamber 34 is unobstructed so a pressure change at the open end 27 of the vacuum tube 16 is communicated through the vacuum tube 16 and through the orifice 23 to the chamber 34.

Because the vacuum tube 16 is in fluid communication with the orifice 23 and the fuel tank 22, a pressure change at the open end 27 of the vacuum tube 16 is communicated through the vacuum tube 16 to the chamber 34. Upon fueling, when the fuel level reaches the open end 27 of the vacuum tube 16, a pressure change is created at the open end 27 of the vacuum tube 16 which is transferred to the pressure sensing port 42 which in turn stops the fuel flow through the fuel pump nozzle 28.

For example, the receiver 18 defines a nipple 38 with the orifice 23 extending from the inner wall 21 through the nipple 38. The vacuum tube 16 is coupled to the nipple 38. The vacuum tube 16 is preferably self clearing. In other words, the vacuum tube 16 should be sized such that the surface tension of the fuel is not able to bridge across the vacuum tube 16, rather fuel empties from the vacuum tube 16 by gravity.

As shown in FIG. 2, the seal 29 may include a first seal 30 and a second seal 32 spaced from the first seal 30. In such a configuration, the first and second seals 30, 32 enclose the orifice 23 for defining the chamber 34 between the inner wall 21, the first and second seals 30, 32, and the fuel pump nozzle 28. The first and second seals 30, 32 may each extend annularly about the axis A. In other words, the first and second seals 30, 32 may be referred to in the art as O-rings.

When the fuel pump nozzle 28 is inserted in the receiver 18, the first and second seals 30, 32 seal around the fuel pump nozzle 28. When fuel is pumped through the fuel pump nozzle 28, the fuel may not travel past the second seal 32 and the fuel travels through the fuel hose 13 toward the fuel tank 22. Each seal 30, 32 may, for example, include a rigid portion and a flexible portion. The rigid portion guides the fuel pump nozzle 28 into the aperture 24 and the flexible portion seals around the fuel pump nozzle 28. For example, the rigid portion may be a metal and the flexible portion may be a rubber. The first and second seals 30, 32 each define an inner diameter D1, D2. The inner diameter D2 of the second seal 32 may be less than the inner diameter D1 of the first seal 30. In such a configuration, additional force is required to insert the fuel pump nozzle 28 past the first seal 30 such that the user may feel when the fuel pump nozzle 28 is approaching the rim 26 to assure full insertion of the nozzle 28 in the receiver 18. The first and second seals 30, 32 create an air-tight seal with the fuel pump nozzle 28 thus creating the chamber 34.

The first and second seals 30, 32 are located such that when the fuel pump nozzle 28 is inserted into the receiver 18, the pressure sensing port 42 is located between the first and second seals 30, 32. The pressure sensing port 42 is exposed to the pressure of the chamber 34 and is therefore exposed to the pressure of the open end 27 of the vacuum tube 16. Upon fueling, when the fuel level in the fuel tank 22 reaches the open end 27 of the vacuum tube 16, a pressure change is created at the open end 27 of the vacuum tube 16 which is transferred to the pressure sensing port 42 which in turn stops the fuel flow through the fuel pump nozzle 28.

Figure 7:
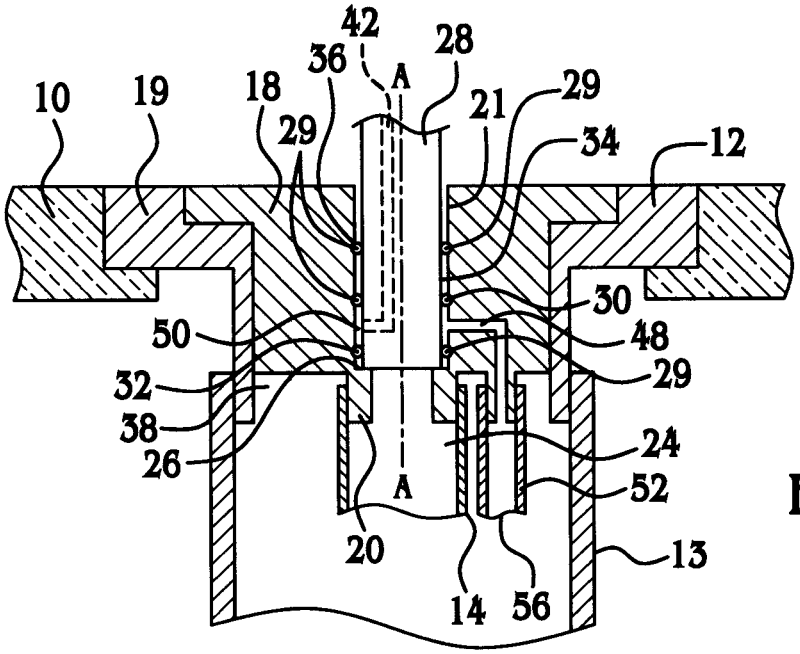
FIG. 7 is a cross-sectional view of another embodiment of the filler tube assembly.

As shown in FIG. 7, the receiver may include a guide seal 36. The guide seal 36 may guide the fuel pump nozzle 28 into the aperture 24. It should be appreciated that the receiver 18 may include any number of guide seals and each guide seal may guide the fuel pump nozzle 28 through the aperture 24.

In such an embodiment, as shown in FIG. 7, the distance between each seal is less than or equal to the distance between a tip of the fuel pump nozzle 28 and the pressure sensing port 42 such that the pressure sensing port 42 is always disposed within the chamber 34 between the seals 30, 32. In such an embodiment, the automatic shut-off system of the fuel pump nozzle 28 is activated when the pressure sensing port 42 of the fuel pump nozzle 28 is disposed on the guide seal 36 or on the first seal 30 or when the pressure sensing port 42 is disposed between the guide seal 36 and the first seal 30. Because the automatic shut-off system is activated when the pressure sensing port 42 is disposed on the guide seal 36 or on the first seal 30 or when the pressure sensing port 42 is disposed between the guide seal 36 and the first seal 30, fuel may only be pumped from the fuel pump nozzle 28 if fuel pump nozzle 28 is properly engaged with the receiver 18 such that the pressure sensing port 42 is disposed between the first seal 30 and the second seal 32.

Figure 8:
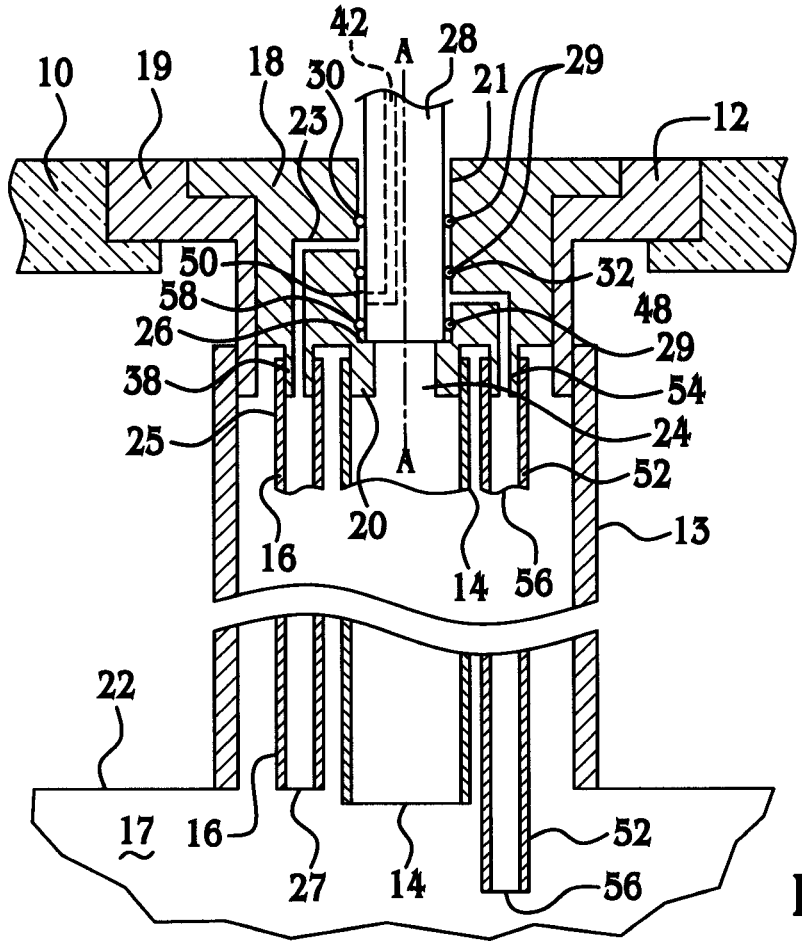
FIG. 8 is a cross-sectional view of another embodiment of the filler tube assembly in use with the fuel pump nozzle and the fuel tank.

As shown in FIG. 8, in another embodiment, the receiver 18 defines a second orifice 48 extending from the inner wall 21 through the receiver 18. The seal 29 encloses the second orifice 48 and separates the second orifice 48 from the orifice 23 for defining the second chamber 50 in communication with the second orifice 48 between the inner wall 21, the seal 29, and the fuel pump nozzle 28. In other words, the second orifice 48 is aligned with the second chamber 50. In the embodiment including the first and second seals 30, 32, the seal 29 may further include a third seal 58 spaced from the second seal 32 opposite the first seal 30, as shown in FIG. 8. The third seal 58 and the second seal 32 create the second chamber 50. In such an embodiment, the first, second, and third seals 30, 32, 58 may each extend annularly about the axis A. In other words, each of the seals 30, 32, 58 may be referred to in the art as O-rings and each of the seals 30, 32, 58 create an air-tight seal with the fuel pump nozzle 28 thus creating the chamber 34 between the first and second seals 30, 32, and creating the second chamber 50 between the second and third seals 32, 58.

In such an embodiment, the filler tube assembly 12 includes a second vacuum tube 52 including a second coupled end 54 coupled to the receiver 18 in fluid communication with the second orifice 48 and a second open end 56 for disposition in fluid communication with the fuel tank 22. It should be appreciated that, without departing from the nature of the present invention, the seal 29 may have any configuration such that the seal 29 encloses the second orifice 48 and separates the second orifice 48 from the orifice 23.

As shown in FIG. 8, the open end 27 of the vacuum tube 16 is located at a different location than the second open end 56 of the second vacuum tube 52. For example, the open end 27 and the second open end 56 may be disposed at different vertical levels. If the pressure sensing port 42 is in fluid communication with the chamber 34, the automatic shut-off system will be activated when the fuel level covers the open end 27. If the pressure sensing port 42 is in fluid communication with the second chamber 50, the automatic shut-off system will be activated when the fuel level covers the second open end 56 of the second vacuum tube 52. As such, a person operating the fuel pump nozzle 28 may select whether the pressure sensing port 42 is in fluid communication with the chamber 34 or the second chamber 50. For example, as shown in FIG. 8, the open end 27 may be located such that the automatic shut-off system is activated when the fuel tank 22 is full, thereby eliminating any room for thermal expansion. The second open end 56 may be located such that the automatic shut-off system is activated before the fuel tank 22 is full, thereby leaving excess volume for thermal expansion. In such a configuration, the person operating the fuel pump nozzle 28 may align the pressure sensing port 42 with the chamber 34 when the fuel tank is being filled immediately prior to fuel consumption in anticipation that the fuel will be consumed before it thermally expands. The person operating the fuel pump nozzle 28 may align the pressure sensing port 42 with the second chamber 50 when immediate fuel consumption is not anticipated and unfilled volume in the fuel tank 22 accommodates for thermal expansion of the fuel.

In the embodiment including the first, second, and third seals 30, 32, 58, the second and third seals 32, 58 may enclose the second orifice 48. Specifically, the second orifice is defined in the inner wall between the second and third seals 32, 58. In other words, the third seal 58 may be disposed between the second seal 32 and the rim 26. In such an embodiment, the operator of the fuel pump nozzle 28 may move the fuel pump nozzle 28 to selectively align the pressure sensing port 42 between the first and second seals 30, 32 or between the second and third seals 32, 58.

As shown in FIG. 8, the first, second, and third seals 30, 32, 58 may each define an inner diameter D1, D2, D3. The inner diameter D3 of the third seal 58 may be less than the inner diameter D1, D2 of the first and second seals 30, 32. In such a configuration, additional force is required to insert the fuel pump nozzle 28 past the third seal 30 such that the user may feel when the fuel pump nozzle 28 is approaching the rim 26 to assure full insertion of the fuel pump nozzle 28 in the receiver 18. Because the inner diameter D3 of the third seal 58 is less than the inner diameters D1, D2 of the first and second seals, the operator of the fuel pump nozzle 28 may feel the fuel pump nozzle 28 passing by the third seal 58 and may thereby align the pressure sensing port 42 with the chamber 34 or the second chamber 50 by feeling from the third seal 58 with the fuel pump nozzle 28.

Figure 9:
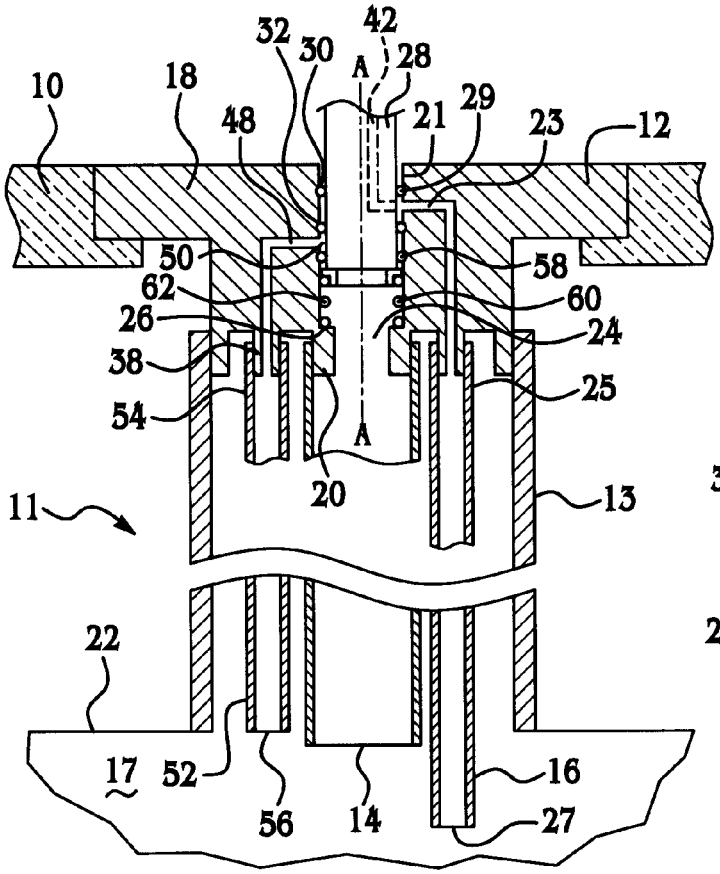
FIG. 9 is a cross-sectional view of another embodiment of the filler tube assembly in use with the fuel pump nozzle and the fuel tank.

Alternatively, as shown in FIG. 9, in the embodiment with the third seal 58 disposed between the second seal 32 and the rim 26, the receiver includes a variable positioning device 60 disposed in the aperture 24 between the rim 26 and the third seal 58 for selectively aligning the pressure sensing port 42 along the axis A. For example, the variable positioning device 60 includes a resilient member 62 resiliently compressible between a first position and a second position for selectively adjusting the alignment of the pressure sensing port 42 along the axis A between the chamber 34 and the second chamber 50. The resilient member 62 is further defined as a coil spring. The variable positioning device 60 may also include a seat disposed on the resilient member 62 to seat the fuel pump nozzle 28 on the variable positioning device 60.

In such an embodiment as shown in FIG. 9, the operator of the fuel pump nozzle 28 inserts the fuel pump nozzle 28 into the aperture 24 and the resilient member 62 aligns the pressure sensing port 42 with the chamber 34. The operator may pump fuel into the fuel tank 22 until the open end 27 of the vacuum tube 16 becomes covered with fuel, thereby activating the automatic shut-off system. If the operator desires to pump additional fuel into the fuel tank 22, the operator exerts force on the fuel pump nozzle 28 to compress the resilient member 62 thereby aligning the pressure sensing port 42 with the second chamber 50. When the resilient member 62 is compressed, the rim 26 provides rigid support for the resilient member 62. The operator may then pump additional fuel into the fuel tank 22 until the second open end 56 of the second vacuum tube 52 is covered by fuel, thereby activating the automatic shut-off system.

It should be appreciated that the pressure sensing port 42 may be selectively aligned with the chamber 34 and the second chamber 50 in any way without departing from the nature of the present invention. For example, the chamber 34 and the second chamber 50 may be configured such that the fuel pump nozzle 28 may be rotated relative to the receiver 18 to align the pressure sensing port 42 with the chamber 34 or the second chamber 50. In such a configuration, the receiver 18 or the deck fitting 19 may include visual indicators to aid the operator of the fuel pump nozzle 28 to determine if the pressure sensing port 42 is aligned with the chamber 34 or the second chamber 50. The receiver 18 or the deck fitting 19 may include a rotational stop that enables the operator of the fuel pump nozzle 28 to feel through the fuel pump nozzle 28 whether the pressure sensing port 42 is aligned with the chamber 34 or the second chamber 50. It should also be appreciated that in such an embodiment, the fuel pump nozzle 28 may rotate relative to the receiver 18, or alternatively, the receiver 18 and the fuel pump nozzle 28 may rotate together relative to the deck fitting 19. Alternatively, the receiver 18 may rotate relative to the deck fitting 19.

Figure 10:
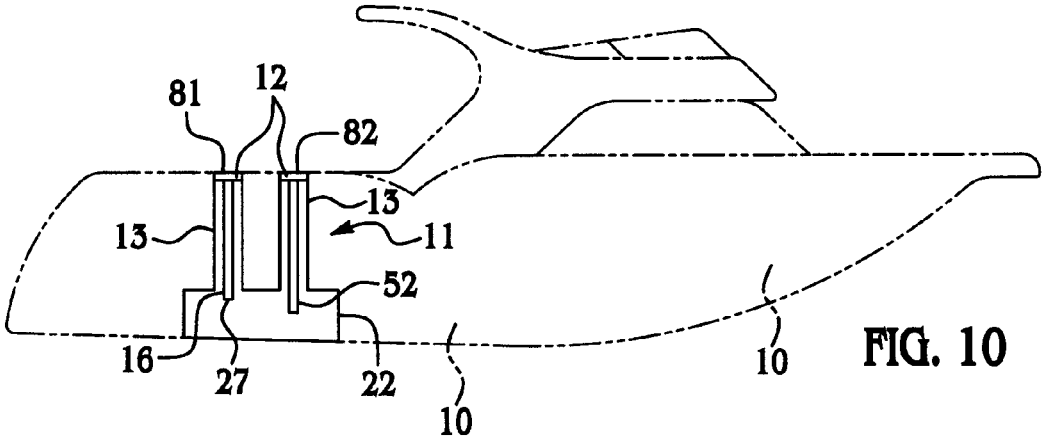
FIG. 10 is a cross-sectional view of another embodiment of the fuel storage system.

As shown in FIG. 10, another embodiment includes a maximum-capacity filler tube assembly 81 and a below-capacity filler tube assembly 82. The maximum-capacity filler tube assembly 81 includes a vacuum sensing tube 16 with the open end 27 that is located such that the automatic shut-off system is activated when the fuel tank 22 is full, thereby eliminating any room for thermal expansion. The below-capacity filler tube assembly 82 includes a vacuum sensing tube 16 with the open end 27 that is located such that the automatic shut-off system is activated before the fuel tank 22 is full, thereby leaving excess volume for thermal expansion. The maximum-capacity filler tube assembly 81 may used, for example, when the fuel tank is being filled immediately prior to fuel consumption in anticipation that the fuel will be consumed before it thermally expands. The below-capacity filler tube assembly 82 may used, for example, when immediate fuel consumption is not anticipated and the excess volume accommodates for thermal expansion of the fuel.

The receiver 18 may be formed from metal and the seal 29 may be formed from an elastomer. For example, the receiver 18 may be formed from stainless steel, brass, aluminum, or copper. Alternatively, the receiver 18 may be formed from materials such as nylon. Further, the receiver 18 is formed from conductive material such that static electricity is discharged through the fill neck 12 to the deck fitting 19, which is grounded.

As shown in FIGS. 2-9, the receiver 18 may include a projection 20 and the filler tube assembly 12 may include an auxiliary fuel hose 14 coupled to the projection 20. In such a configuration, the auxiliary fuel hose 14 extends within the fuel hose 13. Specifically, the auxiliary fuel hose 14 extends from the projection 20 through the fuel hose 13 toward or into the fuel tank 22.

Figure 4:
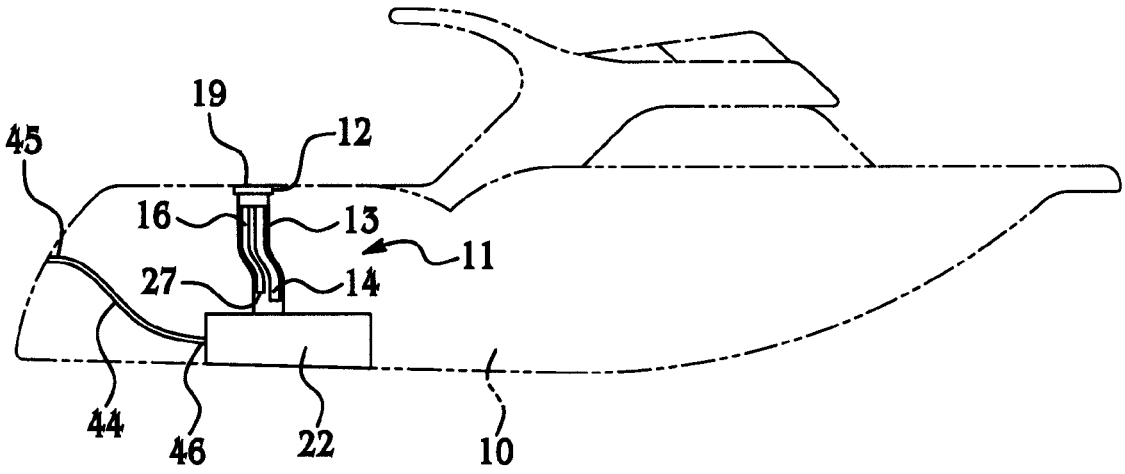
FIG. 4 is a cross-sectional view of the boat with an embodiment of the fuel storage system.

As seen in FIG. 4, the auxiliary fuel hose 14 may extend along a portion of the fuel hose 13 such that the fuel is pumped into the receiver 18, through the auxiliary fuel hose 14, into the fuel hose 13, and into the fuel tank 22. Alternatively, as shown in FIG. 3, the auxiliary fuel hose 14 may extend further than the length of the fuel hose 13 and into the fuel tank 22 such that fuel is pumped into the receiver 18, through the auxiliary fuel hose 14, and into the fuel tank 22. The diameter of the auxiliary fuel hose 14 is generally equal to the diameter of the fuel pump nozzle 28. Because the diameter of the auxiliary fuel hose 14 is generally equal to the diameter of the fuel pump nozzle 28, the fuel pumped from the fuel pump nozzle 28 is pumped into the auxiliary fuel hose 14 without trapping and without forcing air along with the fuel into the auxiliary fuel hose 14. The absence of trapped air allows for a laminar flow of the fuel through the auxiliary fuel hose 14 and eliminates belching that may be caused by trapped air. More specifically, if air becomes trapped with the fuel, the air will build up in the fuel hose, most likely at a bend in the fuel hose. When enough air is trapped in the fuel hose, the air belches out of the receiver 18 and may splash fuel out of the receiver 18. Additionally, the auxiliary fuel hose 14 increases the rate at which fuel may be pumped into a fuel hose 13 that has a contorted shape thereby decreasing the time to fill the fuel tank 22.

Figure 5:
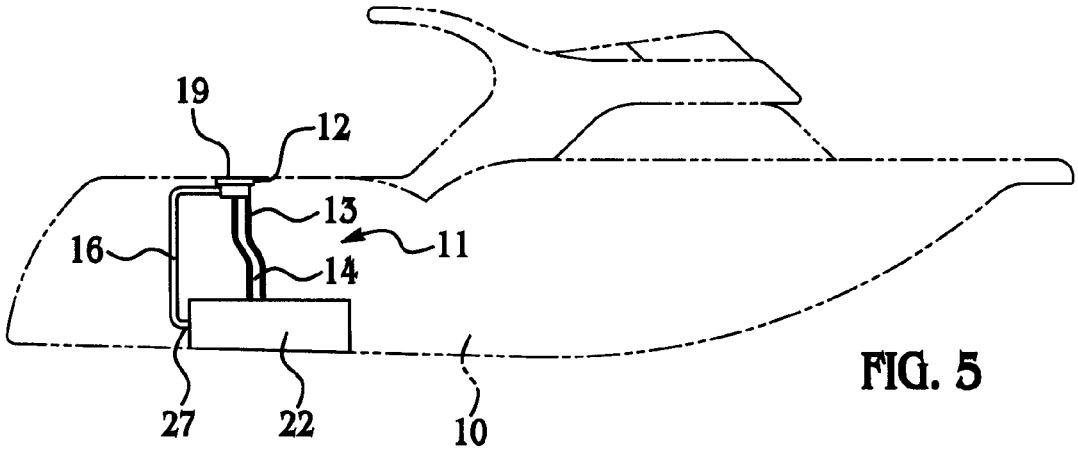
FIG. 5 is a cross-sectional view of the boat with another embodiment of the fuel storage system.

As shown in FIGS. 3 and 4, the vacuum tube 16 may be disposed within the fuel hose 13. Alternatively, as shown in FIG. 5, the vacuum tube 16 may be disposed outside of the fuel hose 13 and extend from the nipple 38 into the fuel tank 22. As shown in FIGS. 3 and 4, if the vacuum tube 16 is disposed within the fuel hose 13, the open end 27 of the vacuum tube 16 is preferably located such that it does not extend beyond the auxiliary fuel hose 14 to prevent splashing fuel inside the fuel tank 22 or splashing fuel from the auxiliary fuel hose 14 from contacting the open end 27 and activating the automatic fuel shut-off system on the fuel pump nozzle 28.

The predetermined vertical position of the open end 27 of the vacuum tube 16 is such that when fuel in the fuel tank 22 reaches a desired level, the fuel level reaches the open end 27 of the vacuum tube 16. Specifically, as shown in FIG. 4 the predetermined vertical position of the open end 27 of the vacuum tube 16 may be such that the fuel level does not reach a vent tube 44 of the fuel tank 22. Additionally, as shown in FIG. 5, the predetermined vertical position of the open end 27 may be such that the fuel tank 22 is filled with fuel before the automatic fuel shut-off system on the fuel pump nozzle 28 is activated. Alternatively, as shown in FIG. 3, the predetermined vertical position of the open end 27 may be such that the fuel does not fill the fuel tank 22, thus leaving excess volume to accommodate, for example, for thermal expansion of the fuel. Alternatively, in an embodiment where the vent tube 44 includes a carbon canister, the predetermined vertical position of the open end 27 may be such that the automatic fuel shut-off system is activated before fuel rises into contact with the carbon canister.

Due to packaging constraints and other constraints, the fuel tank 22 may receive the fuel fill hose 12 on a side of the fuel tank 22. For such a configuration, the open end 27 of the vacuum tube 16 may be fixed in a specified position in the fuel tank 22 such that the automatic fuel shut-off system is activated when the fuel reaches a specified level in the tank.

Figure 11:
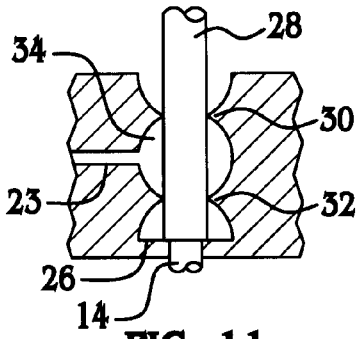
FIG. 11 is a cross-sectional view of another filler tube assembly in use with a fuel pump nozzle

As shown in FIG. 11, in another embodiment the receiver 18 is formed from a flexible material. The seals 30, 32 are formed from the flexible material. When the fuel pump nozzle 28 is inserted in the receiver 18, the rim 26 positions the fuel pump nozzle 28 and each seal 30, 32 creates an air-tight seal around the fuel pump nozzle 28 thus creating the chamber 34. The orifice 23 connects to the chamber 34, which connects to the vacuum tube 16.

Figure 6:
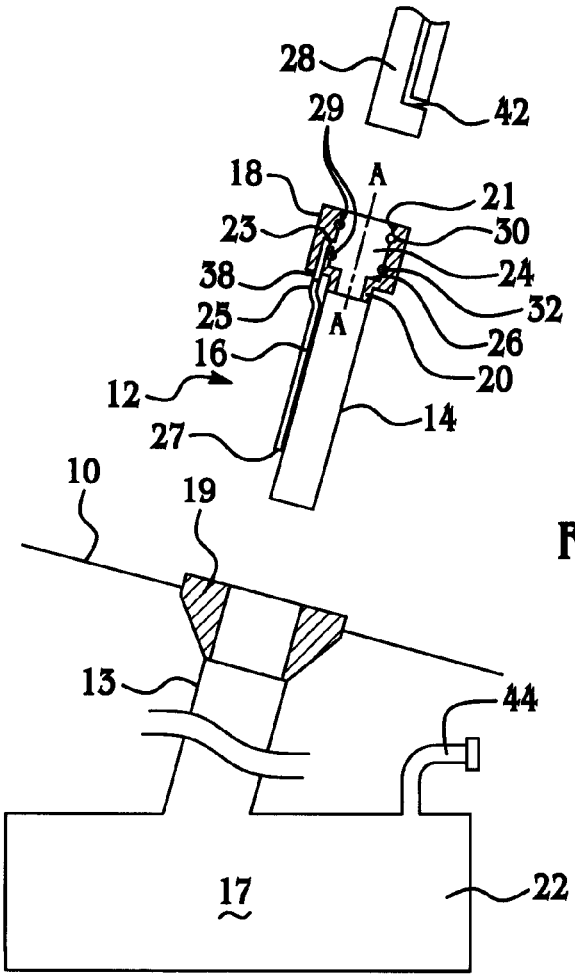
FIG. 6 is a cross-sectional view of an embodiment of the filler tube assembly in use with a fuel pump nozzle and a fuel tank.

In another embodiment, as shown in FIG. 6, the filler tube assembly 12 may be portable. In other words, the filler tube assembly 12, may be separate from the fuel tank 22 and may attached to a fuel pump nozzle 28 for insertion into the deck fitting along with the fuel pump nozzle 28. The fuel pump nozzle 28 may be inserted into the receiver 18 and the receiver 18 may be attached to the fuel pump nozzle 28 to attach the filler tube assembly 12 to the fuel pump nozzle 28. In such an embodiment, the filler tube assembly 12 may be permanently or removably attached to the fuel pump nozzle 28. The filler tube assembly 12 is then inserted into the fuel hose 13 such that fuel may be pumped through the filler tube assembly 12 and into the fuel hose 13. Preferably, as shown in FIG. 6, the auxiliary fuel hose 14 and the vacuum tube 16 are connected. As shown in FIG. 6, a protective cover (not shown) may surround the auxiliary fuel hose 14 and the vacuum tube 16 to protect the auxiliary fuel hose 14 and the vacuum tube 16 and to aid the insertion of the filler tube assembly 12 into the deck fitting and the fuel hose 13. The filler tube assembly 12 that is attached to the fuel pump nozzle 28 may extend from the nozzle 28 through the fuel hose 13 into the fuel tank 22 or may extend from the nozzle 28 partially through the fuel hose 13. When the filler tube assembly 12 shown in FIG. 10 is attached to the fuel pump nozzle 28, when the nozzle 28 is removed from the fuel hose 13 when fueling is completed, the filler tube assembly 12 is removed along with the nozzle 28.

Figure 12:
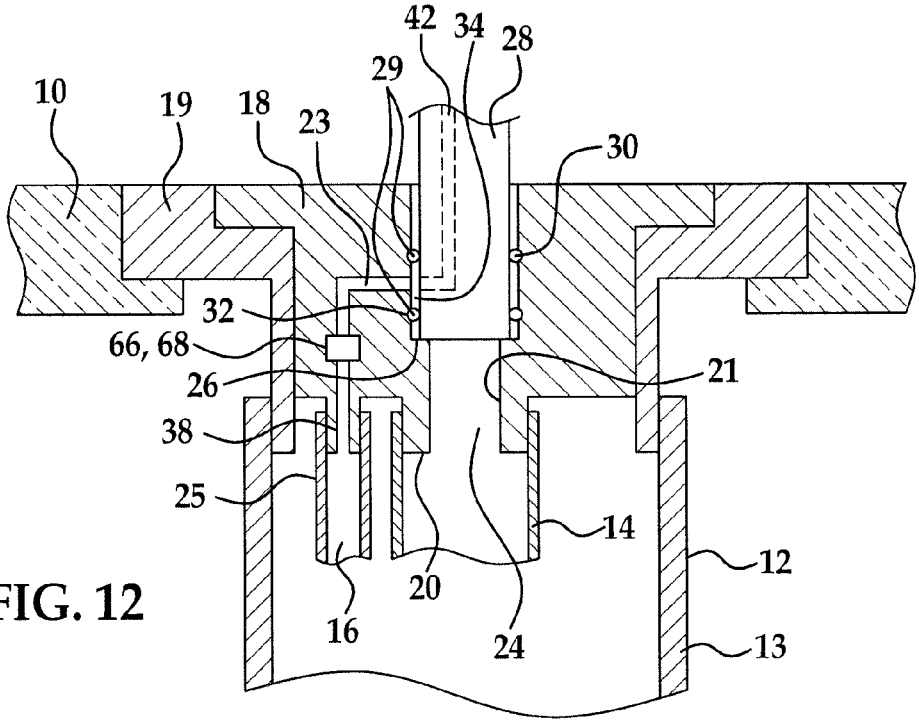
FIG. 12 is a cross-sectional view of a portion of the filler tube assembly including a control unit having a valve and an actuator.
Figure 14:
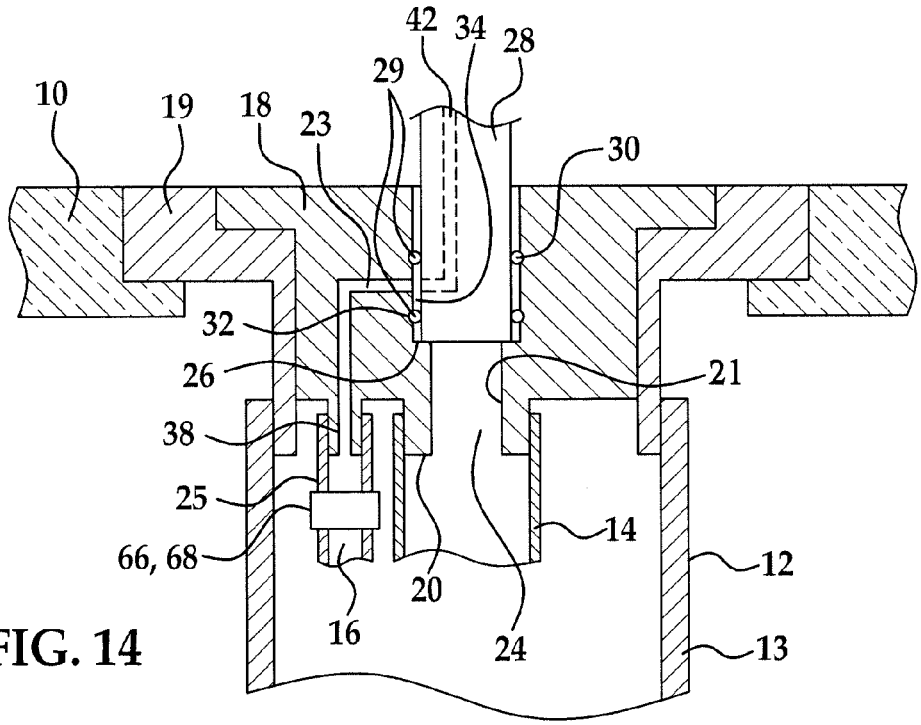
FIG. 14 is a cross-sectional view of a portion of the filler tube assembly including another embodiment of the valve and actuator.
Figure 13:
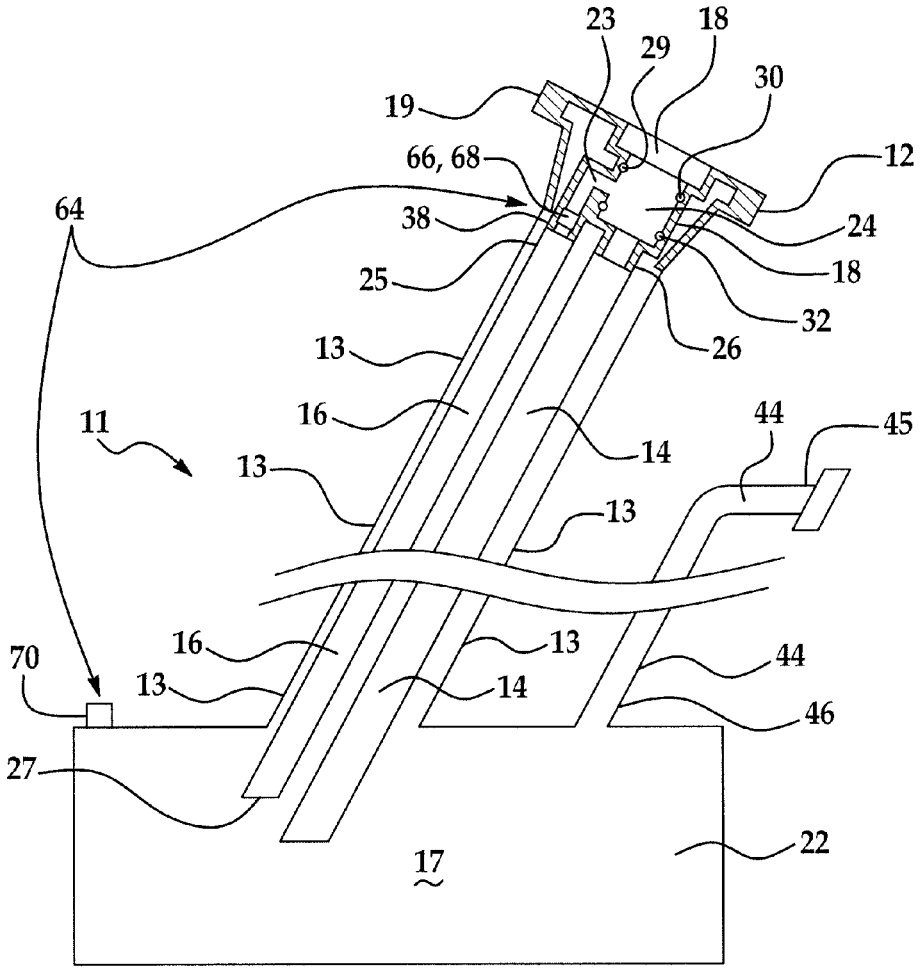
FIG. 13 is a cross-sectional view of the filler tube assembly including level sensor.

As shown in FIGS. 12-14, the filler tube assembly 12 can include a control unit 64 in communication with the orifice 23 of the receiver 18. The control unit 64 can selectively activate the automatic shut-off system of the fuel pump nozzle 28 independently of the fuel level relative to the vacuum tube 16. Specifically, the control unit 64 senses the fuel level in the fuel tank 22 and selectively activates the automatic shut-off system by interrupting communication between the orifice 23 and the chamber 34. The filler tube assembly 12 can include the control unit 64 as an alternative to the vacuum tube 16 or in addition to the vacuum tube 16 to selectively activate the automatic shut-off system of the fuel pump nozzle 28.

The control unit 64 typically includes a valve 66 in fluid communication with the chamber 34 through the orifice 23, an actuator 68 in communication with the valve 66 to actuate, i.e., open and close, the valve 66, and a level sensor 70 in communication with the actuator 68. When the valve 66 is open, air can flow through the orifice 23 to the chamber 34. When the valve 66 is closed, the valve 66 blocks air flow through the orifice 23 to the chamber 34 to activate the automatic shut-off system. The valve 66 is open under normal conditions and when the level sensor 70 senses that the fuel level as at a predetermined level, the level sensor 70 causes the actuator 68 to close the valve 66. It should be appreciated that the level sensor 70 could be in direct communication with the actuator 68 to actuate the valve 66 or, alternatively, the filler tube assembly 12 could include a controller (not shown) in communication with the actuator 68 and the level sensor 70 to control the actuator 68. It should be appreciated that the level sensor 70 can be in communication with the actuator 68 or the controller either by wired connection, radiofrequency, or any other type of communication.

The fuel level sensor 70 can alternatively be in communication, for example, wirelessly, electronically, etc., directly with either the fuel pump nozzle 28 and/or the fuel pump 15 to stop the flow of fuel from the fuel pump 15 when the desired fuel level is reached. In other words, when the fuel level sensor 70 senses that the fuel level is at a predetermined level, the level sensor 70 instructs the fuel pump nozzle 28 or the fuel pump 15 to stop the flow of fuel.

The valve 66 can be any type of valve for interrupting communication between the orifice 23 and the chamber 34. For example, the valve 66 can be of the type commonly referred to as a shut-off valve. As shown in FIG. 12, the valve 66 can be disposed in the receiver 18. Alternatively, as shown in FIG. 14, the valve 66 can be disposed in the vacuum tube 16. It should be appreciated that the valve 66 can be disposed anywhere such that the valve 66 can interrupt communication between the orifice 23 and the chamber 34. The actuator 68 can be of any type and for example, could be a solenoid.

The level sensor 70 can be of any type without departing from the nature of the present invention. For example, the level sensor 70 could ultrasonically measure the fuel level. In such a configuration, the level sensor 70 is typically mounted to the fuel tank 22 above the fuel. The level sensor 70 sends an ultrasonic signal toward the fuel and measures the time for the ultrasonic signal to reach the fuel, reflect off the fuel, and return to the level sensor 70 to determine the fuel level. One such ultrasonic level sensor 70 is the type commercially available from SSI Technologies Inc., of Janesville, Wis., U.S.A. under the tradenames Fluid-Trac® and Acu-Trac®. However, it should be appreciated that the ultrasonic level sensor 70 is set forth above is for exemplary purposes and the level sensor 70 can be of any type. For example, the level sensor could include a sensor (not shown) and a float (not shown) connected to the sensor by an arm. In such a configuration, the float floats on the surface of the fuel and the sensor determines the fuel level by the rotational position of the arm relative to the sensor.

When the filler tube assembly 12 includes the control unit 64 in addition to the vacuum tube 16, control unit 64 can be used as a primary source for activating the automatic shut-off system. In such a configuration, the vacuum tube 16 can be used as a secondary source for activating the automatic shut-off system in case the control unit 64 malfunctions. In other words, if for some reason the control unit 64 does not properly activate the automatic shut-off system, i.e., during an electrical malfunction, the automatic shut-off system will be activated when the fuel level reaches the open end 27 of the vacuum tube 16, as set forth above.

When the filler tube assembly 12 includes the control unit 64 as an alternative to the vacuum tube 16, filler tube assembly 12 need not include the vacuum tube 16. In such a configuration, the orifice 23 of the control unit 64 need not be in fluid communication with the fuel tank 22 but can instead be in fluid communication with atmospheric pressures when the valve 66 is open.

The invention has been described in an illustrative manner, and it is to be understood that the terminology which has been used is intended to be in the nature of words of description rather than of limitation. Obviously, many modifications and variations of the present invention are possible in light of the above teachings, and the invention may be practiced otherwise than as specifically described.

What is claimed is:

1. A filler tube assembly for communicating fuel from a fuel pump nozzle to a fuel tank with the fuel pump nozzle having a pressure sensing port, said filler tube assembly comprising:

a receiver having an inner wall defining an aperture for receiving the fuel pump nozzle with said inner wall defining an orifice extending through said inner wall transverse to said aperture;

a seal coupled to said inner wall about said orifice for defining a chamber between said inner wall, said seal, and the fuel pump nozzle; and an air path extending between a first end in fluid communication with said orifice and a second end for disposition in fluid communication with the fuel tank;

said receiver defining an abutting surface rigidly extending from said inner wall into said aperture for seating the fuel pump nozzle in said aperture to dispose the pressure sensing port in said chamber and to align the pressure sensing port with said orifice.

2. The filler tube assembly as set forth in claim 1 wherein said aperture extends along an axis and said abutting surface extends annularly about said axis.

3. The filler tube assembly as set forth in claim 1 wherein said abutting surface projects perpendicularly from said inner wall.

4. The filler tube assembly as set forth in claim 1 wherein said abutting surface and said inner wall are integrally formed from a common material.

5. The filler tube assembly as set forth in claim 1 wherein said receiver is formed from metal and wherein said seal is formed from an elastomer.

6. The filler tube assembly as set forth in claim 1 wherein said seal includes a first seal and a second seal spaced from said first seal with said first and second seals enclosing said orifice for defining the chamber between said inner wall, said first and second seals, and the fuel pump nozzle.

7. The filler tube assembly as set forth in claim 6 wherein said aperture extends along an axis and wherein said first and second seals each extend annularly about said axis.

8. The filler tube assembly as set forth in claim 1 wherein said receiver defines a second orifice extending from said inner wall through said receiver and wherein said seal encloses said second orifice and separates said second orifice from said orifice for defining a second chamber in communication with said second orifice between said inner wall, said seal, and said fuel pump nozzle.

9. The filler tube assembly as set forth in claim 8 wherein said seal includes a first seal and a second seal spaced from said first seal with said first and second seals enclosing said orifice and a third seal spaced from said second seal opposite said first seal with said second and third seals enclosing said second orifice.

10. The filler tube assembly as set forth in claim 9 wherein said aperture extends along an axis and wherein said first, second, and third seals each extend annularly about said axis.

11. The filler tube assembly as set forth in claim 10 wherein said third seal is disposed between said second seal and said rim and wherein said first, second, and third seals each define an inner diameter and wherein said inner diameter of said third seal is less than said inner diameter of said first and second seals.

12. The filler tube assembly as set forth in claim 10 wherein said third seal is disposed between said second seal and said abutting surface and wherein said receiver includes a variable positioning device disposed in said aperture between said abutting surface and said third seal for selectively aligning the pressure sensing port along said axis.

13. The filler tube assembly as set forth in claim 1 further including a fuel hose coupled to said receiver in alignment with said aperture for coupling with the fuel tank to communicate fuel from said receiver to the fuel tank.

14. The filler tube assembly as set forth in claim 13 further comprising a vacuum tube defining said air path and extending from said receiver into said fuel hose.

15. A fuel storage system for receiving fuel from a fuel pump nozzle having a pressure sensing port, said fuel storage system comprising:

a fuel tank defining an interior for storing fuel;

a vent tube including an first end for communication with ambient atmosphere and a second end coupled to said fuel tank and in fluid communication with said interior; and a filler tube assembly coupled to said fuel tank for communicating fuel from a fuel pump nozzle to said fuel tank, said filler tube assembly comprising:

a receiver having an inner wall defining an aperture for receiving the fuel pump nozzle with said inner wall further defining an orifice extending through said inner wall transverse to said aperture;

a seal coupled to said inner wall about said orifice for defining a chamber between said inner wall, said seal, and the fuel pump nozzle; and an air path extending between a first end in fluid communication with said orifice and a second end disposed in fluid communication with said fuel tank;

said receiver defining an abutting surface rigidly extending from said inner wall into said aperture for seating the fuel pump nozzle in said aperture to dispose the pressure sensing port in said chamber and to align the pressure sensing port with said orifice.

16. The fuel storage system as set forth in claim 15 wherein said abutting surface extends annularly about said axis.

17. The fuel storage system as set forth in claim 15 wherein said abutting surface projects perpendicularly from said inner wall.

18. The fuel storage system as set forth in claim 15 wherein said abutting surface and said inner wall are integrally formed from a common material.

19. The fuel storage system as set forth in claim 15 wherein said receiver is formed from metal and wherein said seal is formed from an elastomer.

20. The fuel storage system as set forth in claim 15 wherein said seal includes a first seal and a second seal spaced from said first seal with said first and second seals enclosing said orifice for defining the chamber between said inner wall, said first and second seals, and the fuel pump nozzle.

21. The fuel storage system as set forth in claim 20 wherein said first and second seals each extend annularly about said axis.

22. The filler tube assembly as set forth in claim 1 further comprising a rim in said aperture presenting said abutting surface.

23. The fuel storage system as set forth in claim 15 further comprising a rim in said aperture presenting said abutting surface.

24. The filler tube assembly as set forth in claim 15 further comprising a vacuum tube defining said air path and extending from said receiver into said fuel hose.

* * * * *